US006765477B2

(12) United States Patent
Right et al.

(10) Patent No.: US 6,765,477 B2
(45) Date of Patent: Jul. 20, 2004

(54) APPARATUS AND METHOD FOR ACTIVATING A NON-CONTACT SWITCH FIRE ALARM PULL STATION

(75) Inventors: Robert W. Right, Bradenton Beach, FL (US); Hilario S. Costa, Sarasota, FL (US)

(73) Assignee: Edwards Systems Technology, Inc., Cheshire, CT (US)

( * ) Notice: Subject to any disclaimer, the term of this patent is extended or adjusted under 35 U.S.C. 154(b) by 0 days.

(21) Appl. No.: 10/135,408

(22) Filed: May 1, 2002

(65) Prior Publication Data

US 2003/0206096 A1 Nov. 6, 2003

(51) Int. Cl.[7] ..... G08B 13/02

(52) U.S. Cl. ..... 340/286.05; 200/43.01; 340/286.06; 340/287

(58) Field of Search ..... 340/286.05, 286.06, 340/287, 300, 305, 307; 200/61.71, 61.73, 61.85, 43.01, 43.07, 547

(56) References Cited

U.S. PATENT DOCUMENTS

| | | | | | |
|---|---|---|---|---|---|
| 4,267,549 | A | * | 5/1981 | Taylor | 340/302 |
| 4,359,719 | A | * | 11/1982 | Schwarzer | 340/287 |
| 4,551,707 | A | * | 11/1985 | Simpson | 340/287 |
| 4,728,928 | A | * | 3/1988 | Shipley | 340/287 |

* cited by examiner

*Primary Examiner*—Brent A. Swarthout
(74) *Attorney, Agent, or Firm*—Baker & Hostetler LLP

(57) ABSTRACT

A method and apparatus for activating a fire-alarm pull station. The pull stations includes a non-contact switch located within a housing, a movable actuation device linked to the non-contact switch wherein the device moves between an activation and non-activation position and an actuator protector linked to the non-contact switch to aid in preventing improper activation of the non-contact switch.

19 Claims, 4 Drawing Sheets

APPARATUS AND METHOD FOR ACTIVATING A NON-CONTACT SWITCH FIRE ALARM PULL STATION

FIELD OF THE INVENTION

The present invention relates generally to activation switches. More particularly, the present invention relates to activating fire alarm pull stations in environments that tend to be harsh to contact switches. The present invention also relates to preventing accidental tripping of these alarms by the influence of outside elements.

BACKGROUND OF THE INVENTION

Manually operated fire alarm pull stations have been in existence for a number of years. Their primary function is to allow occupants to initiate a signal in a fire alarm control panel. The panels are strategically located throughout a property in easy to find locations. The frequency of the locations of these devices is driven by the fact that earlier notification of a possible emergency situation usually results in less damage to property as well saving human life.

Once the fire alarm is activated, the fire alarm system alerts a predetermined number of individuals. This usually involves the building occupants, fire brigade or municipal fire department. An alert is sent so that the appropriate individuals coordinate a response to the alarm. For example, in the event of a fire alarm activation, the local municipalities coordinate by sending the nearest available unit to the designated location. The alarm can also result in responses from the local police and ambulance services.

The pull stations have served to act as a quick response to conditions in which response time is critical. Therefore, the pull stations, like all mechanical devices, need to be maintained to ensure their operability.

Pull stations, of the contact switch type, are susceptible to mechanical failure. One of the primary causes of this mechanical failure is due to environmental conditions. For example, the pull stations are located in the outdoors, parking structures, factories, chemical processing plants and oil refineries. These harsh environments cause contaminants to interfere with the operability of the switch mechanism. To ensure the operability of the switch, the device needs to be maintained on a periodic basis.

Periodic maintenance of the pull station requires coordinating with local emergency personnel and/or alarm monitoring companies as to testing or maintenance taking place on the premise. For example, either the alarm system needs to be shut down or the local authorities need to be apprised of the maintenance that is taking place. Either action insures that if the device is accidentally activated during maintenance, emergency personnel will not be summoned to the location preventing the diversion of the emergency personnel from more critical matters.

A parking garage under renovation or maintenance is a good example of how contact switch-based pull stations are susceptible to mechanical failure at a greater rate than usual. Construction environments create a number of airborne contaminants or particles. These particles are moved and circulated through the structure by the movement of the automobiles and construction equipment. Some of this debris works its way into the fire alarm pull station. The debris begins to pile on the contacts in the switch. After certain coverage of the debris on the switch occurs, the switch ceases to function in that it is not able to make electrical contact. Failure of the switch causes a greater period of time to be added to the response time of the emergency personnel. Furthermore, the activator of the pull station might be led into a false sense of security in that the switch is activated and the appropriate personnel have been alerted.

Accordingly, it is desirable to provide a fire alarm pull station is activated on a non-contact switch basis. Furthermore, it is desirable to provide a non-contact switch, which when subject to conditions or effects could accidentally trip or actuate the alarm.

SUMMARY OF THE INVENTION

The features and advantages of the invention are achieved through the use of a novel non-contact switch that is shielded to prevent accidental activation as herein disclosed. In accordance with another embodiment of the present invention, a fire alarm pull station includes a housing, a non-contact switch that is located within the housing and a movable actuation device linked to the non-contact switch. The movable actuation device moves between an activation and non-activation position. A further element is an actuator protector linked to the non-contact switch. The actuator protector ensures that the non-contact switch is not activated accidentally through some external environmental condition. In the preferred embodiment, the non-contact switch is a Hall-effect switch. To enable activation of the switch, a magnet is attached to the movable actuation lever. The magnet creates a magnetic field, which causes a Hall voltage to activate the switch.

The actuator protector, when incorporating the use of a Hall effect switch, uses similar magnetic fields. The similar fields prevent an outside magnetic field from activating the device accidentally. In the preferred embodiment, the actuator protector and the non-contact switch merge into one device called a biased operation Hall effect switch.

In another aspect of the invention, a manually operated activation lever is replaced with a push button switch. The switch operates to activate the Hall switch through the creation of a magnetic field.

In another embodiment of the invention, a method is provided for actuating a fire alarm pull station in an alarm system. The method includes the steps of shielding a non-contact switch from accidental activation, sensing the movement of a movable actuation device by the non-contact switch into an actuation position and alerting predetermined sequence in response to the actuation position. A further step in this alternate embodiment is deactivating the switch upon resetting the alarm system. As an example in a push-button activation switch, the magnet is removed from the proximity of the Hall switch to deactivate the magnetic field as well as the Hall voltage.

In the step of sensing the movement of a movable actuation device, the alternate embodiment includes moving an actuation device into an actuation position, creating a magnetic field by placing the actuation device into the actuation position and supplying a voltage to the non-contact switch.

In yet another embodiment of the invention, an apparatus for actuating a fire alarm pull station in an alarm system, including means for shielding a means for switching from accidental activation, means for sensing the movement of a movable, means for actuating by the means for switching into an actuation position and means for alerting a predetermined sequence in response to the actuation position.

In a further aspect of this alternate embodiment, means for sensing the movement of a movable actuation device comprises means for moving an actuation device into an actuation position, means for creating a magnetic field by placing the actuation device into the actuation position and means for supplying a voltage to the non-contact switch.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides a non-contact switch that is shielded with an actuator protector to prevent improper or accidentally activation of a fire alarm pull station.

Figure 1:
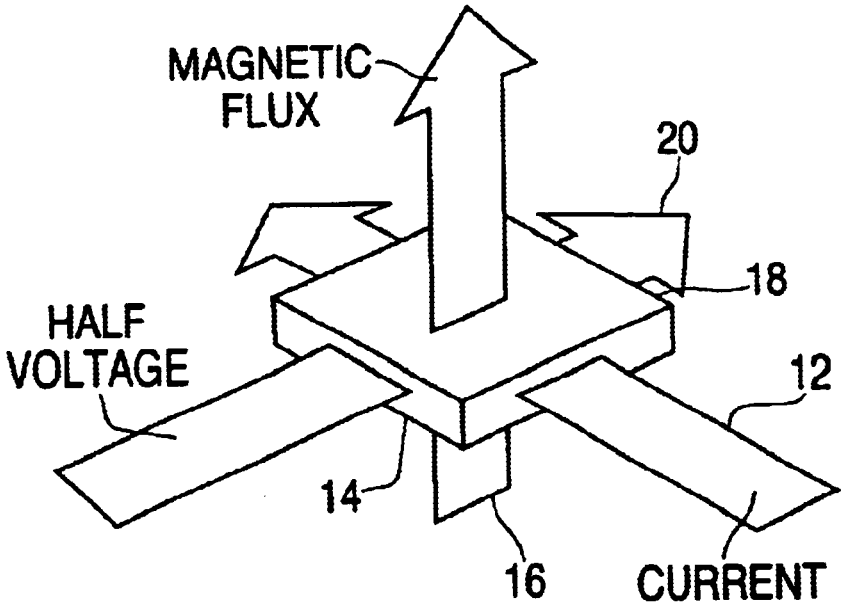
FIG. 1 is an illustration of the Hall effect.

FIG. 1 is an illustration of the Hall effect and the ability to use the effect to act as a non-contact switch device. Primarily, a current 12 is directed through a metal, semiconductor or substrate 14 in a certain manner or direction. By adding a magnetic field 16 perpendicular to the current flow 12, electrons 18 resulting from the current flow 12, are predominantly forced to one side of the substrate 14. A voltage drop is detected by measuring the difference between the electron side and the non-electron side of the substrate. The difference detected is known as the Hall Voltage 20. The Hall voltage 20 is related to the magnetic field applied. Therefore, a comparison can be accomplished to determine if the measured Hall voltage 20 is the result of certain expected happenings, i.e. the introduction of a magnet into the current and the strength of the field applied. As a result of the Hall effect, excessive charge appears on one side of the substrate 14. This phenomenon has been incorporated into such things as an actuation switch or sensor.

Figure 2:
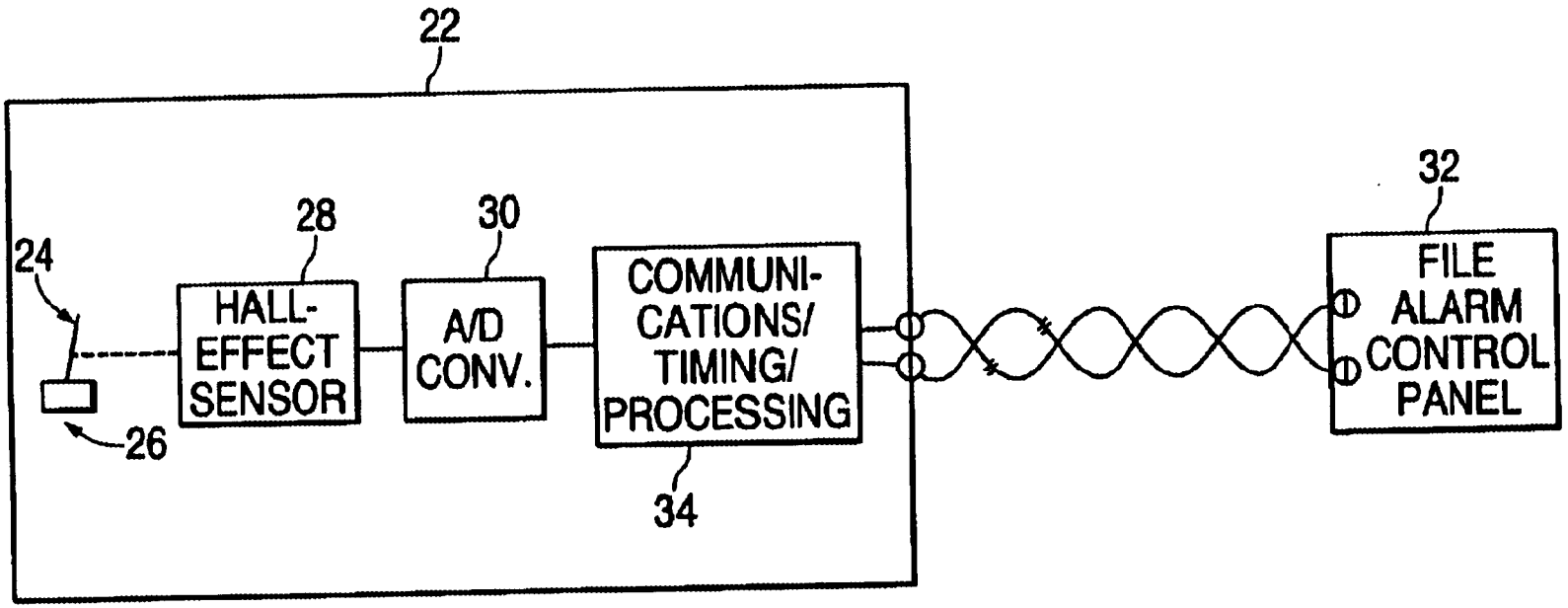
FIG. 2 an illustration of a preferred embodiment of the present invention.

FIG. 2 an illustration of a preferred embodiment of the present invention. In the present invention, the Hall effect is used as a switch to activate a fire alarm pull station. A housing 22 encases a number of elements that help assemble the current invention. The housing 22 has evolved from a metal casting to plastic covering. The latter is more likely to be seen or located in an indoors setting. Since their introduction, the metal casting was used in all locations but is now predominately used in exterior locations to protect the operability of the switch from physical damage.

The housing 22 is comprised of a movable actuation device 24, which appears on the exterior of the housing 22. In the preferred embodiment, the movable actuation device 24 is a manually operated lever, which can be placed in two positions. The first position is an "off" or "non-actuation" position. The second position is an "on" or "actuation" position.

Attached to the movable actuation device 24 is a magnet 26. The magnet 26 serves to create the magnetic field needed to activate the fire alarm pull station. In the "off" or "non-actuation" position, the magnet 26 is located at proximity to where a magnetic field is not created by its presence in the housing. When the movable actuation device 24 is placed in the actuation or on position, the magnet 26 is placed in a location close enough to a Hall effect switch 28 in order to create a magnetic field capable of generating a Hall voltage to activate the Hall effect switch 28.

The movable actuation device 24 is not limited to the use of a manually operated level to which the magnet 26 is attached. Another such device is a push button switch that helps create a magnetic field similar to that of the movable actuation device 24.

The Hall effect switch 28 is placed in a location to where the movable actuation device 24, with attached magnet 26, is placed in close proximity to enable the Hall effect switch 28 to activate the fire alarm pull station. When an individual detects a hazardous condition that requires an emergency response, the individual moves the movable actuation device 24 into the on or activation location. The activation location places a magnet 26 within the premises of the Hall effect switch 28. The magnet 26 produces a magnetic field perpendicular to the current flowing through the switch. As a result, a Hall voltage significant enough to activate the switch 28 is detected and transmitted to an analog to digital converter 30.

The analog to digital converter 30 enables the fire alarm station to communicate with the fire alarm control panel 32. The output of the analog to digital converter 30 serves as the input into a processor 34, which serves a number of functions. First, it serves to connect the fire alarm pull station to the central fire alarm control panel 36. The connection between the two devices can be a wire or non-wire based such as transmission through radio frequency. Some examples of non-wire transmission are BLUE-TOOTH™ and infrared detection.

The output of the analog to digital converter 30 is fed into the processor 34 to where the data is analyzed. The processor 34 is programmed to activate the alarm on the receipt of certain output data from the analog to digital converter 30. An output from the analog to digital converter 30 can result from a number of different scenarios. For example, a magnetic field not created by the pull station can induce the Hall effect switch 28 to generate an output. In this instance, this can activate a "false alarm", which has the effect of tying up valuable resources. To remedy this problem, the processor is programmed to analyze the output from the analog to digital converter 30. In the instance of the alarm station being subject to an outside magnetic field, the processor 34 may detect a Hall voltage but an alarm signal not sent to the control station. The processor 34 is programmed to detect the magnetic field created by the movable actuating device 24.

The processor 34 includes an internal or external memory device. Data is stored on the memory device as to threshold values for determining whether the movable actuation switch 24 was moved or positioned into the "on" or "actuation" position. As values are received by the processor 34 from the analog to digital converter 30, a comparison of these values done against the threshold values in the memory and a determination is made as to whether the movable actuation device 24 was moved to the "on" or actuation position. In essence, the processor 34 adds another layer of protection to ensure that random magnetic fields that generate output from the analog to digital converter 30 do not trip the alarm in a non-emergency situation.

Figure 3:
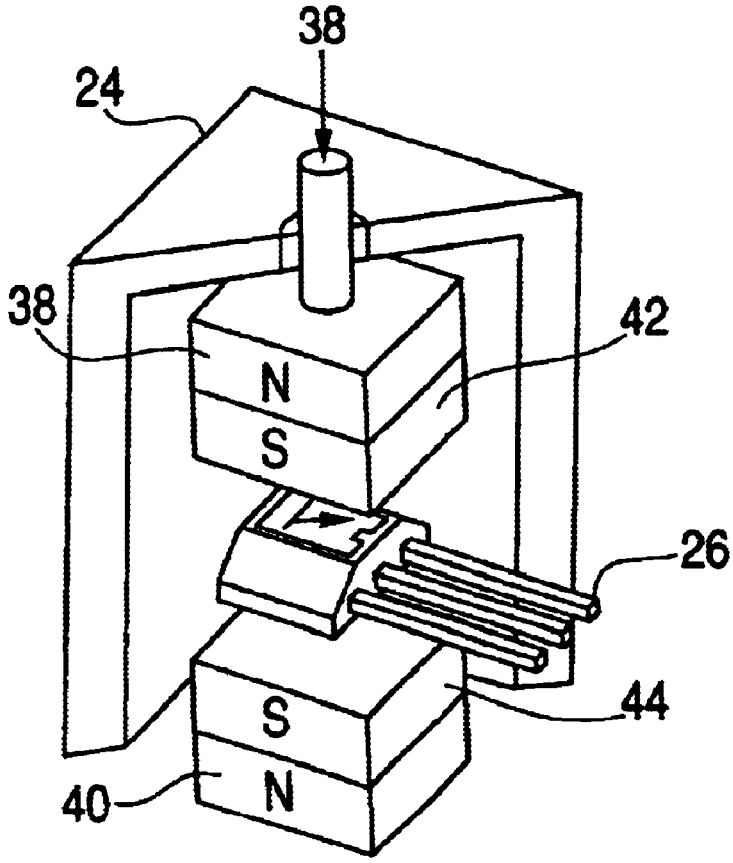
FIG. 3 is an illustration of a push-button movable actuating device.

FIG. 3 is an illustration of an alternate embodiment of the movable-actuating device 24, which is a biased operation push 38. Biased operation is a method or technique of controlling the field surrounding the Hall effect sensor or switch 26. In this illustration, bias magnets 40, 42 are used to position the Hall switch 26 in a non-actuation position. In essence, the bias magnets 38, 40 serve to ensure that a Hall voltage is not detected or generated. The opposing south poles 42, 44 serve as a return spring once the push-button 38 is set in the off position.

The Hall switch 26 is held in the off position until a south pole of a large magnitude is introduced to the proper face of the switch 26. This has the effect of canceling out the opposing magnetic flux created by south pole 44. This design ensures that the Hall switch 26 does not activate accidentally in the presence of other opposing magnetic fields.

When the push button 38 is activated or moved to the on position, the bias magnet 42 moves in proximity to the Hall switch 26. This results in a positive flux density canceling out the negative flux density provided by the south pole 44. This canceling out generates the Hall voltage, which activates or turns the switch 26 into the on position. To turn off the switch 26, the push button 38 is depressed, which removes the barrier that prevented the bias magnets 42, 44 from repelling from each one another. This event deactivates or turns the switch off.

Figure 4:
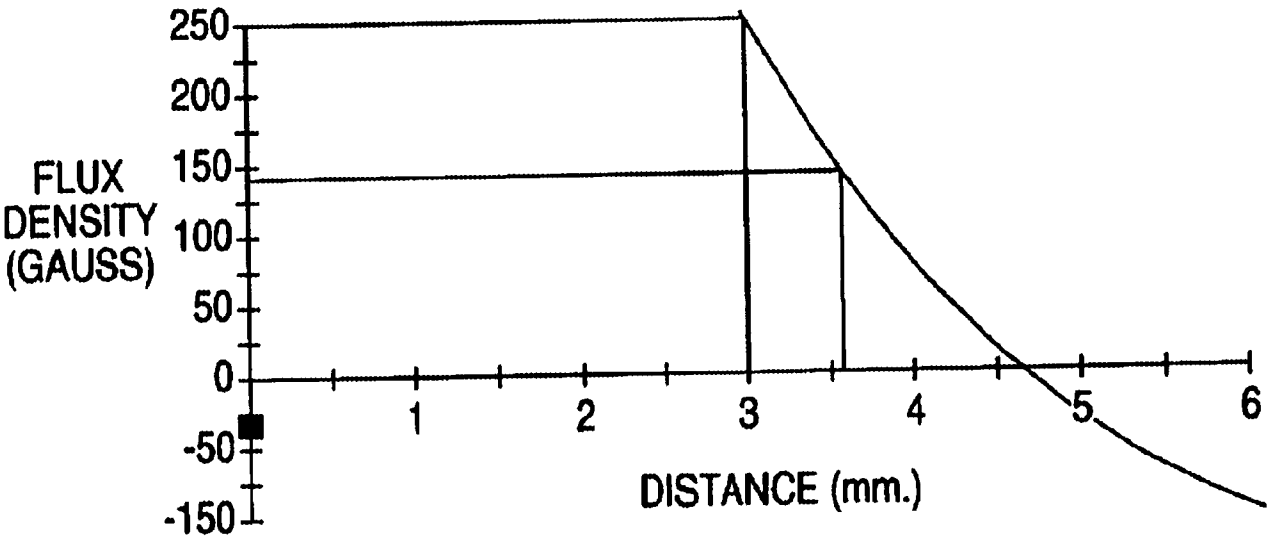
FIG. 4 is a graph of the effects of a biased operation Hall effect switch.
Figure 1:
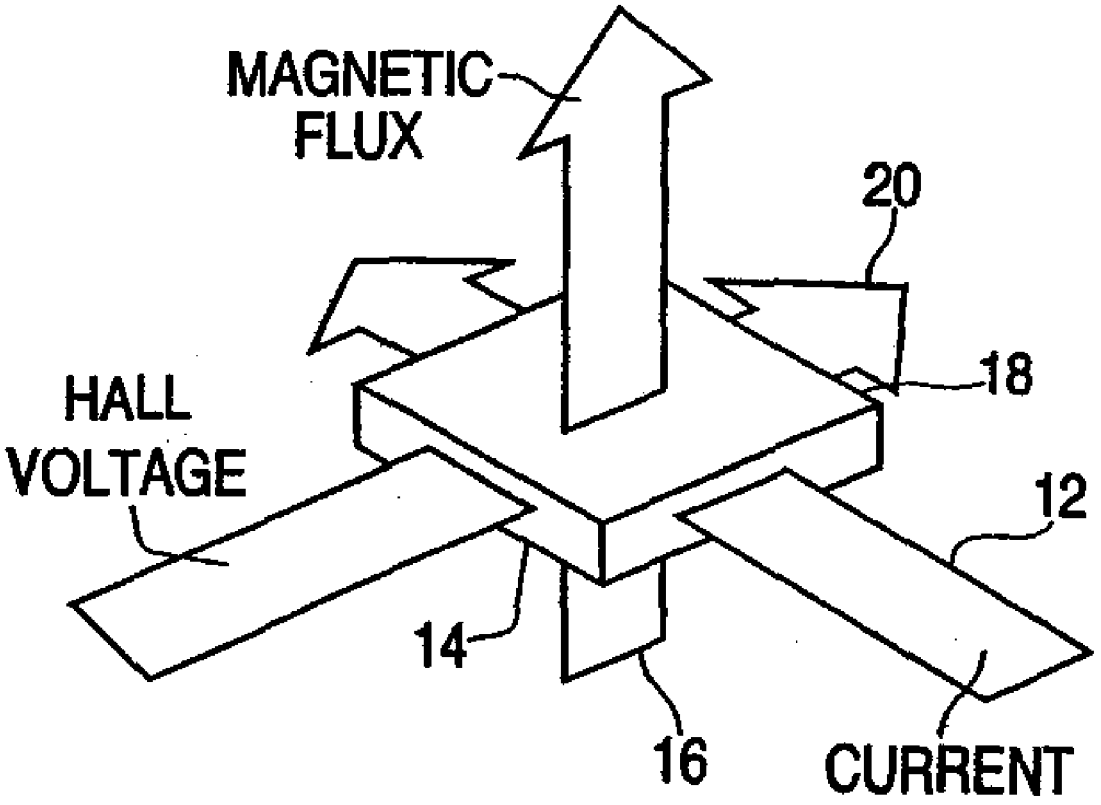
Figure 3:
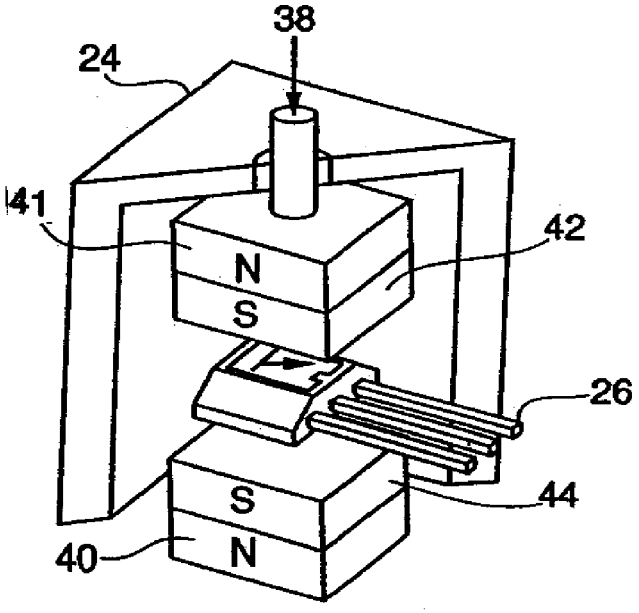

FIG. 4 is a graph, which shows the effects of the bias magnet 44 incorporated into the Hall switch 26. The bias magnet 44 is placed no less than four millimeters from the reverse side of the hall switch 26. This produces a flux density of −245 Gauss. As the graph details, Gauss measurements outside of the four-millimeter range will not operate or activate the Hall switch. The bias magnet 44 keeps the Hall switch 26 in a magnetic field until a stronger south pole overcomes the bias magnet's 44 flux density. This occurs when the push button 38 is moved to the on-position.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fire alarm station comprising:

a non-contact switch;

a movable actuation device linked to the non-contact switch wherein the device moves between an activation and non-activation position; and an actuator protector linked to the non-contact switch to aid in preventing improper activation of the non-contact switch, wherein the actuator protector is the positioning of similar magnetic fields on opposing sides of the non-contact switch.

2. The fire alarm station of claim 1, wherein the non-contact switch is a Hall-effect switch.

3. The fire alarm station of claim 1, wherein the movable actuation device is an actuated lever with an attached magnet.

4. The fire alarm station of claim 1, wherein the similarly magnetic field is comprised of south magnetic fields.

5. The fire alarm station of claim 1, wherein the actuator protector is biased operation Hall effect switch.

6. The fire alarm station of claim 1, wherein the movable actuation device is a push button switch.

7. The fire alarm station of claim 6, wherein the push button switch moves the actuation protector.

8. A method of actuating a fire alarm pull station in an alarm system, comprising:

magnetically shielding a non-contact switch from accidental activation by placing similar magnetic fields on opposing sides of the non-contact switch;

sensing the movement of a movable actuation device by the non-contact switch into an actuation position; and alerting the alarm system in response to the actuation position;

placing similar magnetic fields on opposing sides of the non-contact switch.

9. The method of claim 8, further comprising deactivating the switch upon resetting the alarm system.

10. The method of claim 8, wherein the step of sensing the movement of a movable actuation device comprises the steps of:

moving an actuation device into an actuation position;

creating a magnetic field by placing the actuation device into the actuation position; and supplying a voltage to the non-contact switch.

11. The method of claim 10, wherein a magnet is attached to the actuation device.

12. The method of claim 8, wherein the non-contact switch is a Hall effect switch.

13. The method as in claim 8, wherein the actuation device locates one of the similar magnetic fields in proximity of the non-contact switch to create a magnetic field.

14. An apparatus for actuating a fire alarm pull station in an alarm system, comprising:

means for actuating the fire alarm pull station;

means for magnetically shielding the means for activating from accidental activation;

means for determining activation of the fire alarm pull station; and means for alerting a predetermined sequence in response to the activation;

wherein the means for shielding the means for activating comprises similar magnetic fields on opposing sides of a Hall effect switch.

15. The apparatus of claim 14, further comprising a means for deactivating the means for activating upon resetting the alarm system.

16. The apparatus of claim 14 wherein the means for determining activation comprises:

means for moving an actuation device into an actuation position;

means for creating a magnetic field by placing the actuation device into the actuation position; and means for supplying a voltage to the means for activating.

17. The apparatus of claim 16, wherein a magnet is attached to the actuation device.

18. The apparatus of claim 14, wherein the means for activating is a Hall effect switch.

19. The method as in claim 14, wherein the means for activating locates one of the similar magnetic fields in proximity of the Hall effect switch to create a magnetic field.

* * * * *

UNITED STATES PATENT AND TRADEMARK OFFICE

CERTIFICATE OF CORRECTION

PATENT NO. : 6,765,477 B2
DATED : July 20, 2004
INVENTOR(S) : Robert W. Right et al.

It is certified that error appears in the above-identified patent and that said Letters Patent is hereby corrected as shown below:

Drawings,
Figure 1, replace “Half” with -- Hall -- (see attached figure).
Figure 3, replace “38” (bias magnets) with -- 41 -- (see attached figure).

Column 2,
Line 8, after “station” please insert -- that --.
Line 10, after “could” insert -- not --.

Column 5,
Line 22, replace “40, 42” with -- 40, 41 --.
Line 24, replace “38, 40” with -- 40, 41 --.

Signed and Sealed this

Nineteenth Day of October, 2004

JON W. DUDAS
*Director of the United States Patent and Trademark Office*